US007475459B2

(12) United States Patent
Rhyne

(10) Patent No.: US 7,475,459 B2
(45) Date of Patent: Jan. 13, 2009

(54) APPARATUS AND METHOD FOR CONDITIONING AIR-ENTANGLED YARN

(76) Inventor: Jeffrey T. Rhyne, 9 S. Central Ave., Belmont, NC (US) 28012

( * ) Notice: Subject to any disclaimer, the term of this patent is extended or adjusted under 35 U.S.C. 154(b) by 0 days.

(21) Appl. No.: 12/014,424

(22) Filed: Jan. 15, 2008

(65) Prior Publication Data

US 2008/0110150 A1 May 15, 2008

Related U.S. Application Data

(63) Continuation of application No. 10/938,300, filed on Sep. 10, 2004.

(51) Int. Cl.
*D02J 1/22* (2006.01)

(52) U.S. Cl. ..... 28/258; 28/247; 28/245; 28/240; 28/220

(58) Field of Classification Search ..... 28/240, 28/241–244, 245, 246, 247, 248, 250–252, 28/271, 258, 219, 220, 281; 57/310, 351, 57/908, 309, 1 UN, 287
See application file for complete search history.

(56) References Cited

U.S. PATENT DOCUMENTS

| | | | | |
|---|---|---|---|---|
| 2,621,390 | A | | 12/1952 | Nield |
| 3,143,784 | A | | 8/1964 | Scott |
| 3,295,181 | A | | 1/1967 | McIntosh |
| 3,298,079 | A | | 1/1967 | Agett et al. |
| 3,457,610 | A | | 7/1969 | Williams et al. |
| 3,500,519 | A | | 3/1970 | Stanley |
| 3,650,103 | A | * | 3/1972 | Farrar et al. ..... 57/289 |
| 3,701,248 | A | | 10/1972 | Gray |
| 3,703,753 | A | | 11/1972 | Binford et al. |
| 3,831,231 | A | | 8/1974 | Binford et al. |
| 3,931,941 | A | | 1/1976 | Hornbuckle |
| 3,946,548 | A | | 3/1976 | Hino et al. |
| 3,983,608 | A | | 10/1976 | Stanley |
| 4,019,229 | A | * | 4/1977 | Chastang ..... 28/267 |
| 4,033,103 | A | | 7/1977 | Vukoje |
| 4,070,815 | A | | 1/1978 | Negishi et al. |
| 4,152,886 | A | | 5/1979 | Nelson |
| 4,162,607 | A | | 7/1979 | Spivey |
| 4,263,368 | A | * | 4/1981 | Otaki et al. ..... 428/373 |
| 4,316,311 | A | * | 2/1982 | Feffer ..... 28/248 |
| 4,345,425 | A | * | 8/1982 | Negishi et al. ..... 57/289 |
| 4,430,852 | A | * | 2/1984 | Hatcher ..... 57/247 |
| 4,550,880 | A | | 11/1985 | Niederer |
| 4,557,689 | A | * | 12/1985 | Krenzer ..... 432/59 |
| 4,591,105 | A | | 5/1986 | Niederer |
| 4,608,736 | A | | 9/1986 | Tajiri et al. |
| 4,778,118 | A | | 10/1988 | Niederer |
| RE33,111 | E | | 11/1989 | Niederer |

(Continued)

*Primary Examiner*—Amy B Vanatta
(74) *Attorney, Agent, or Firm*—Adams Intellectual Property Law, P.A.

(57) ABSTRACT

A yarn conditioning apparatus and methods for removing interlace nodes from a multifilament, crimped yarn, and including a first roll assembly for accepting the multifilament, interlaced yarn from a yarn supply at a predetermined yarn feed rate and outputting the yarn, and a second yarn roll assembly having a yarn feed rate greater than the yarn feed rate of the yarn input roll assembly for accepting the output yarn from the first roll assembly and stretching the yarn to a degree sufficient to remove interlace nodes from the yarn and outputting the conditioned yarn to downstream processes.

15 Claims, 6 Drawing Sheets

U.S. PATENT DOCUMENTS

| | | | | |
|---|---|---|---|---|
| 4,899,426 | A | | 2/1990 | Hand |
| 4,912,820 | A | | 4/1990 | Bregier |
| 4,934,134 | A | | 6/1990 | Niederer |
| 4,949,440 | A | | 8/1990 | Niederer et al. |
| 4,965,919 | A | | 10/1990 | Fujita et al. |
| 5,027,486 | A | | 7/1991 | Niederer |
| 5,050,816 | A | | 9/1991 | Niederer |
| 5,511,295 | A | * | 4/1996 | Shah ..... 28/254 |
| 5,594,968 | A | | 1/1997 | Haselwander et al. |
| 5,826,812 | A | | 10/1998 | Hand |
| 5,832,552 | A | | 11/1998 | Haselwander |
| 6,027,059 | A | | 2/2000 | Hand |
| 6,052,983 | A | | 4/2000 | Moran et al. |
| 6,089,009 | A | | 7/2000 | Hand et al. |
| 6,195,975 | B1 | | 3/2001 | Hand et al. |
| 6,345,491 | B1 | | 2/2002 | Moran et al. |
| 6,419,283 | B1 | | 7/2002 | Thomas et al. |
| 6,494,922 | B1 | | 12/2002 | Rhyne et al. |
| 6,641,181 | B2 | | 11/2003 | Thomas et al. |

* cited by examiner

APPARATUS AND METHOD FOR CONDITIONING AIR-ENTANGLED YARN

CROSS-REFERENCE TO RELATED APPLICATIONS

This application is a Continuation Application claiming filing date priority to U.S. patent application Ser. No. 10/938,300 filed Sep. 10, 2004 and entitled "Apparatus and Method for Conditioning Air-Entangled Yarn," the contents of which are hereby incorporated by reference.

TECHNICAL FIELD AND BACKGROUND OF THE INVENTION

This invention relates to an apparatus and method for conditioning air-entangled yarn. The invention has particular application in processing relatively high denier, multifilament yarns, such as carpet yarn, that are delivered from a yarn manufacturer or other processor with pre-inserted crimp. When used to manufacture carpets, the yarn is processed to form differing, complementary colors that are intended to provide to the carpet a blended, muted color effect.

Often, such yarns are "tacked" or "interlaced" during initial processing to make the yarn more manageable and easy to handle. These terms, used herein interchangeably, refer to any one of several processes by which the multifilaments are locked together at intervals. The process often includes the use of short-interval blasts of high-pressure air sufficient to entangle short lengths of the yarn, referred to herein as "interlace nodes." While this process does increase the coherence of the yarn and thus aids processing during the crimp-inserting process, it has been observed that when processed in this manner, carpets tufted from such yarns have a somewhat harsh appearance, where the varying blended colors of the yarn are more distinct and less muted than desired. Particularly when an additional entangling process is used to add further loft and bulk to the yarn, the existence of many closely-spaced interlace nodes acts to restrict the degree of additional bulk that can be added to the yarn and impairs the ability to achieve the fullest possible color blending.

The method and apparatus according to the method disclosed and claimed in this application provides a simple and effective means of removing and/or loosening a sufficient number of the interlace nodes to allow the yarn to assume a more bulked, bloomed condition wherein the crimp of the individual filaments is allowed to position the filaments in a greater, more varied, three-dimensional randomized arrangement. The process is generally referred to as "conditioning" the yarn to render it more suitable for its end use without removing the twist or breaking filaments.

SUMMARY OF THE INVENTION

Therefore, it is an object of the invention to provide a yarn conditioning apparatus.

It is another object of the invention to provide a yarn conditioning apparatus that removes or loosens a sufficient number of interlace nodes in a multifilament crimped yarn.

It is another object of the invention to provide a yarn conditioning apparatus that conditions a crimped, interlaced yarn by stretching the yarn to a degree sufficient to remove or loosen interlace nodes while not removing the crimp, or breaking the yarn or filaments of the yarn.

These and other objects of the present invention are achieved in the preferred embodiments disclosed below by providing a yarn conditioning apparatus for removing interlace nodes from a multifilament, crimped yarn, and comprising a first roll assembly for accepting the multifilament, interlaced yarn from a yarn supply at a predetermined yarn feed rate and outputting the yarn, and a second yarn roll assembly having a yarn feed rate greater than the yarn feed rate of the yarn input roll assembly for accepting the output yarn from the first roll assembly and stretching the yarn to a degree sufficient to remove interlace nodes from the yarn and outputting the conditioned yarn to downstream processes.

According to one preferred embodiment of the invention, the first yarn roll assembly comprises a feed roll and an entry roll for passing a yarn therebetween under positive, non-slipping condition.

According to another preferred embodiment of the invention, the second yarn roll assembly comprises a feed roll and an entry roll for passing a yarn therebetween under positive, non-slipping condition.

According to yet another preferred embodiment of the invention, the first yarn roll assembly comprises an entry roll for accepting yarn from a yarn supply and a tension roll positioned in spaced-apart relation to the entry roll downstream therefrom. A feed roll is positioned between the entry roll and the tension roll for being driven by a motor at the predetermined feed rate, and a nip belt extends around a belt path defined by complementary peripheral surfaces of the entry roll, tension roll and feed roll. The yarn is fed by the entry roll into a nip at an infeed point of contact between the nip belt and the feed roll, positively fed between the nip belt and the feed roll and delivered at an outfeed point of contact between the nip belt and the feed roll downstream of the feed roll.

According to yet another preferred embodiment of the invention, the second yarn roll assembly comprises an entry roll for accepting yarn fed from the first yarn roll assembly, and a tension roll positioned in spaced-apart relation to the entry roll downstream therefrom. A feed roll is positioned between the entry roll and the tension roll for being driven by a motor at the feed rate greater than the feed rate of the first yarn roll assembly. A nip belt extends around a belt path defined by complementary peripheral surfaces of the entry roil, tension roll and feed roll. The yarn is fed by the entry roll into a nip at an infeed point of contact between the nip belt and the feed roll, positively fed between the nip belt and the feed roll and delivered at an outfeed point of contact between the nip belt and the feed roll downstream of the feed roll.

According to yet another preferred embodiment of the invention, the first yarn assembly and the second yarn assembly each include a tracking roll positioned intermediate the respective entry rolls and tension rolls for adjusting the tracking of the nip belt over the surfaces of the respective entry, feed and tension rolls.

According to yet another preferred embodiment of the invention, a single drive motor is provided for driving both the first and second feed rolls at their respective feed rates.

According to yet another preferred embodiment of the invention, a first drive motor is provided for driving the feed roll of the first yarn roll assembly and a second drive motor is provided for driving the feed roll of the second yarn roll assembly.

According to yet another preferred embodiment of the invention, an upstream creel is provided for supplying the yarn to the first feed roll assembly. A downstream yarn processing station is provided for receiving the conditioned yarn fed from the second yarn roll assembly. A take-up is provided for winding the yarn delivered from the yarn processing station onto a suitable yarn package.

According to yet another preferred embodiment of the invention, the yarn processing station comprises an air entangler for inserting tangled loops into the yarn.

According to yet another preferred embodiment of the invention, the yarn processing station includes tension reducing rolls for relieving stretch in the yarn delivered from the second yarn roll assembly.

According to yet another preferred embodiment of the invention, the feed rate and thus the stretch of the second yarn roll assembly is between 1-25 percent, or more typically 7 and 20 percent, greater than the feed rate of the first yarn roll assembly.

An embodiment of the method of conditioning a yarn of the type comprising a multifilament twisted yarn having spaced-apart interlace nodes therein according to the invention comprises the steps of positively feeding the multifilament, interlaced yarn from a yarn supply at a predetermined yarn feed rate to a first yarn roll assembly and outputting the yarn from the first yarn roll assembly to a second yarn roll assembly having a yarn feed rate greater than the yarn feed rate of the yarn input roll assembly. The yarn is stretched between the first yarn roll assembly and the second yarn roll assembly to a degree sufficient to remove interlace nodes from the yarn. The conditioned yarn is fed from the second yarn roll assembly and delivered downstream where one or more processes on the yarn are performed on the yarn.

According to another preferred embodiment of the invention, the step of stretching the yarn comprises the step of successively feeding the yarn between a feed roll and nip belt of the first yarn roll assembly and between a feed roll and nip belt of the second yarn roll assembly.

According to yet another preferred embodiment of the invention, the step of stretching the yarn comprises the step of stretching the yarn between 7 and 20 percent.

According to yet another preferred embodiment of the invention, the method includes the step of relieving tension in the yarn caused by stretching downstream of the second yarn roll assembly.

According to yet another preferred embodiment of the invention, the step of performing one or more processes on the yarn comprises the steps of relieving stretch-induced tension in the yarn downstream of the second yarn roll assembly, and performing a bulk-enhancing process on the yarn.

According to yet another preferred embodiment of the invention, the bulk-enhancing process comprises air entangling the yarn.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
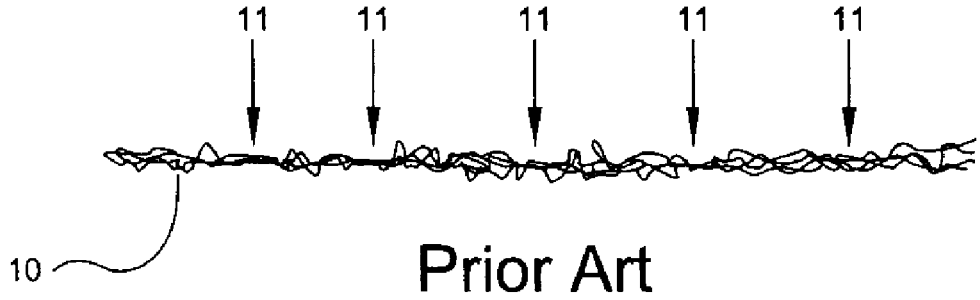
FIG. 1 is a schematic view of a length of crimped, multifilament yarn with interlace nodes according to the prior art.

Referring now specifically to the drawings, a schematic representation of a conventional crimped, multifilament producer yarn is shown at reference numeral 10. Such yarns 10 may, for example, range in denier from 600 to 3000 with a typical denier per filament of 4.5 to 25. To aid in processing the yarn 10 is interlaced at intervals along its length to increase coherence. The interlacing is represented by interlace nodes 11 which may be spaced at, for example, 1-3 inches (7.6 cm) apart. While this process does increase the coherence of the yarn and thus aids processing during the crimp-inserting process, it has been observed that when yarns are processed in this manner, carpets tufted from such yarns have a somewhat harsh appearance with less bulk, where the varying blended colors of the yarn are more distinct and less muted than desired.

Figure 2:
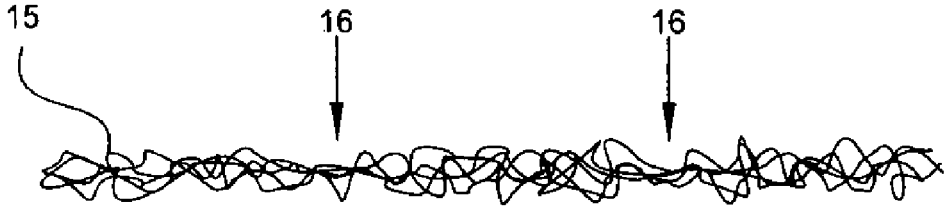
FIG. 2 is a schematic view of a length of crimped, multifilament yarn after processing according to the apparatus and method of the invention disclosed herein.

Referring now to FIG. 2, the method and apparatus according to the method disclosed and claimed in this application provides a simple and effective means of removing and/or loosening a sufficient number of the interlace nodes to allow the yarn to assume a more bulked, bloomed condition wherein the crimp of the individual filaments is allowed to position the filaments in a greater, more varied, three-dimensional randomized arrangement.

As is shown with reference to yarn 15 the yarn processed as described herein has assumed a bulkier, more lofted configuration as a result of the nodes 11 having been removed or loosened. As represented at reference numeral 16, some nodes may remain, but are sufficiently widely spaced-apart and loosened that the yarn 15 is allowed to bloom to a greater degree. This yarn condition permits the creation of a smoother, more blended appearance to carpets tufted from the yarns 15.

Figure 3:
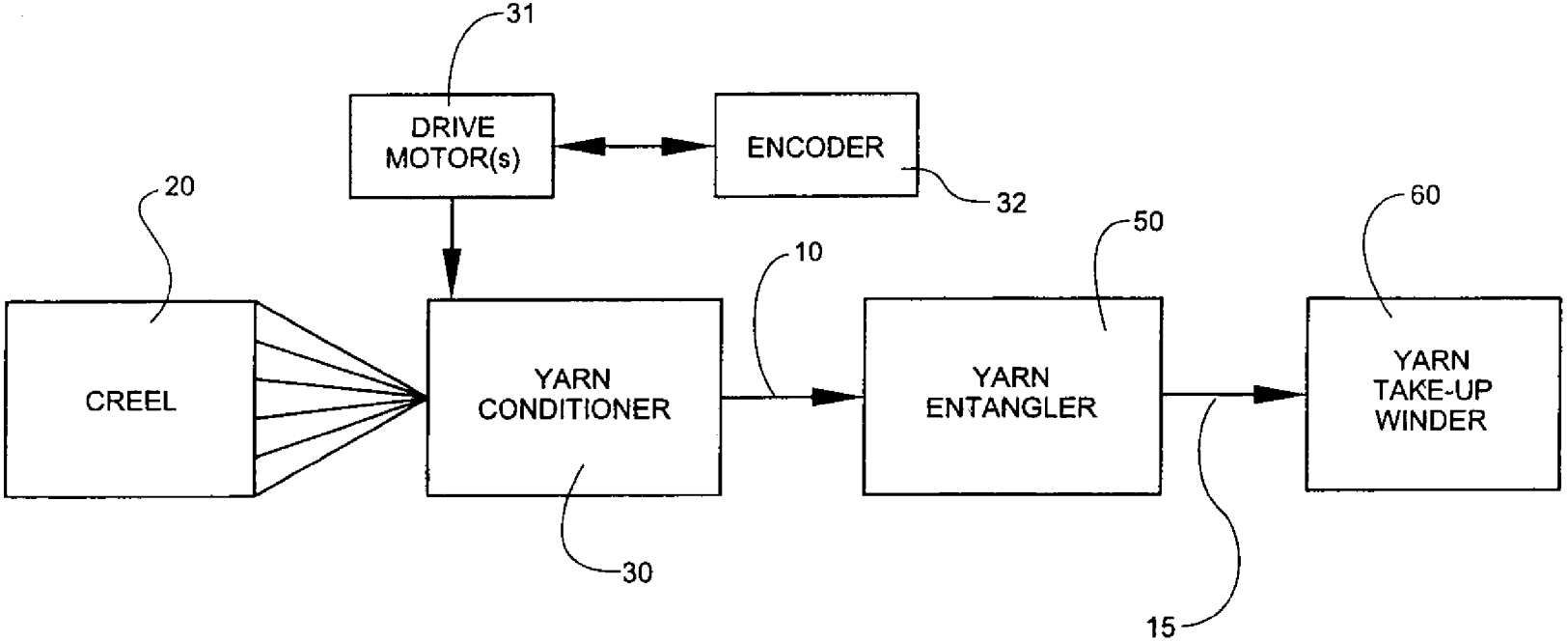
FIG. 3 is a simplified flow diagram of the method according to an embodiment of the invention.

Referring now to FIG. 3, the yarn conditioning process is broadly illustrated. Yarns, such as yarns 10, are supplied from a creel 20 and are pulled by the yarn conditioner 30 from the creel 20, condensed into a single strand, and fed into the operating elements of the yarn conditioner 30, described below, by one or more drive motors 31. An encoder 32 may optionally be used with the drive motor 31 to monitor and control the absolute and relative feed rates of the operating elements of the yarn conditioner 30. After the yarn is conditioned, it is fed to a processing station, such as an air-jet yarn entangler 50, where the yarn 10 is processed, resulting in a yarn 15 as shown in FIG. 2. The yarn 15 is then taken up by a conventional take-up, such as a winder 60.

Figure 4:
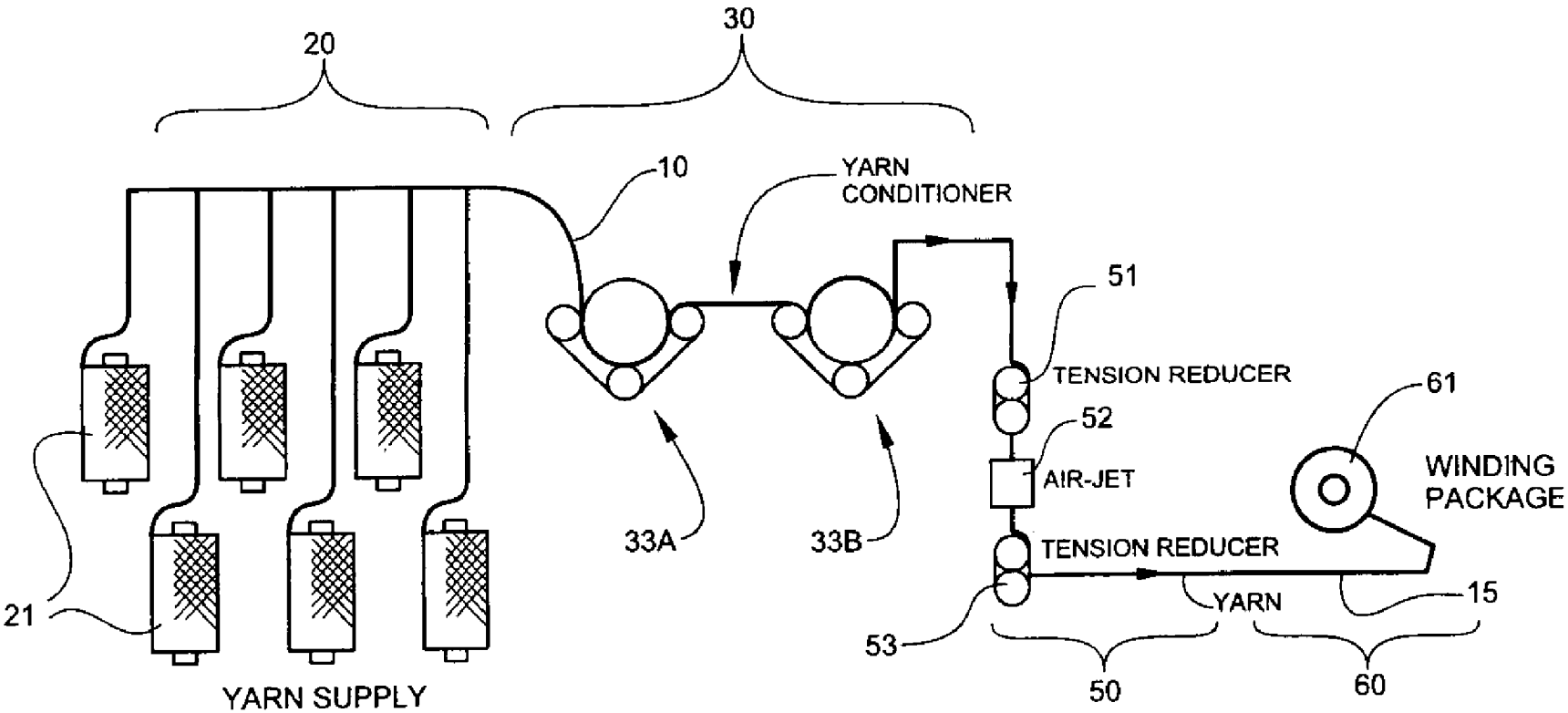
FIG. 4 is a simplified schematic of the apparatus according to an embodiment of the invention.

Referring now to FIG. 4, the yarn conditioner 30 and related upstream and downstream elements are more specifically described. Creel 20 has a plurality of yarn positions, each of which holds a supply package 21 of crimped yarn. Typically, yarns from the yarn supply packages 21 are condensed into a single yarn 10 that is fed to the yarn conditioner 30. The yarn conditioner 30 is comprised of two yarn roll assemblies 33A and 33B that stretch the yarn 10 sufficiently to remove or loosen the interlace nodes 11, as described above, but without removing the crimp or breaking the yarn. Tension in the yarn 10 created by the stretching is relieved by a first tension reducer 51. The yarn 10 is then processed at, for example, an air-jet entangler 52, overfed to a downstream tension reducer 53, and finally to a take-up winder 60, where the conditioned yarn 15 is wound onto a take-up package 61. Where a 48 position creel 20 is feeding the yarn conditioner 30, and where 6 yarns are being condensed into a single yarn 10, an 8-position take-up winder 60 is sufficient to accommodate the output of the process. However, the invention in not limited to any particular number or sizes of yarns being fed to or from the yarn conditioner 30. A typical yarn production rate is in the range of 600 yds/min (549 m/min).

In addition to conventional air entangling, rotary jet and rotary twist processes such as disclosed in applicant's U.S. Pat. Nos. 6,345,491 and 6,195,975 and any other process for entangling, randomizing or fluid twisting benefit from the conditioning method described above, and are included within the meaning of "yarn processing station" and downstream "processes."

The creel 20, air entangler 50 and take-up 60 are conventional and are not discussed further.

Figure 5:
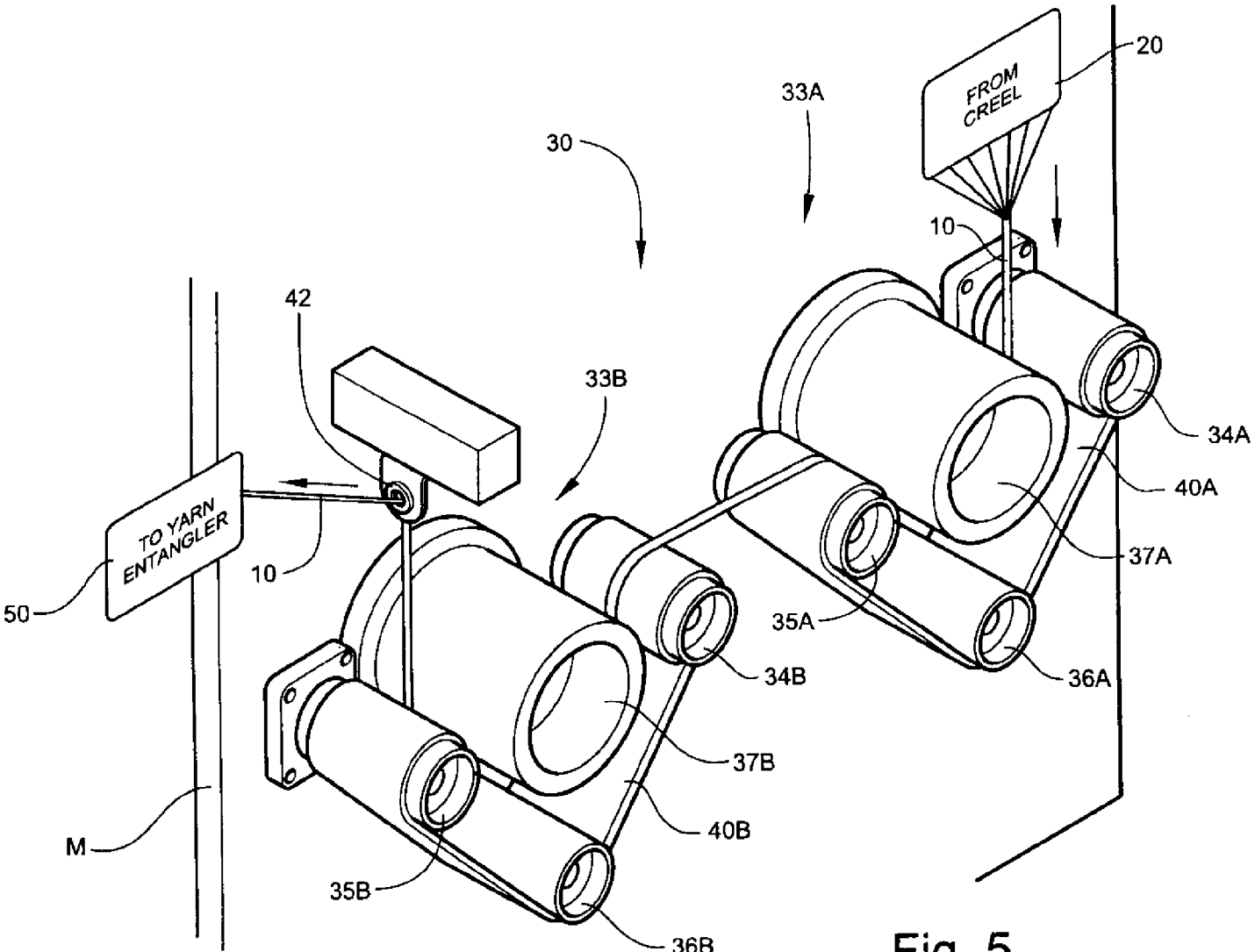
FIG. 5 is a fragmentary perspective view of the first and second yarn roll assemblies according to an embodiment of the invention.
Figure 6:
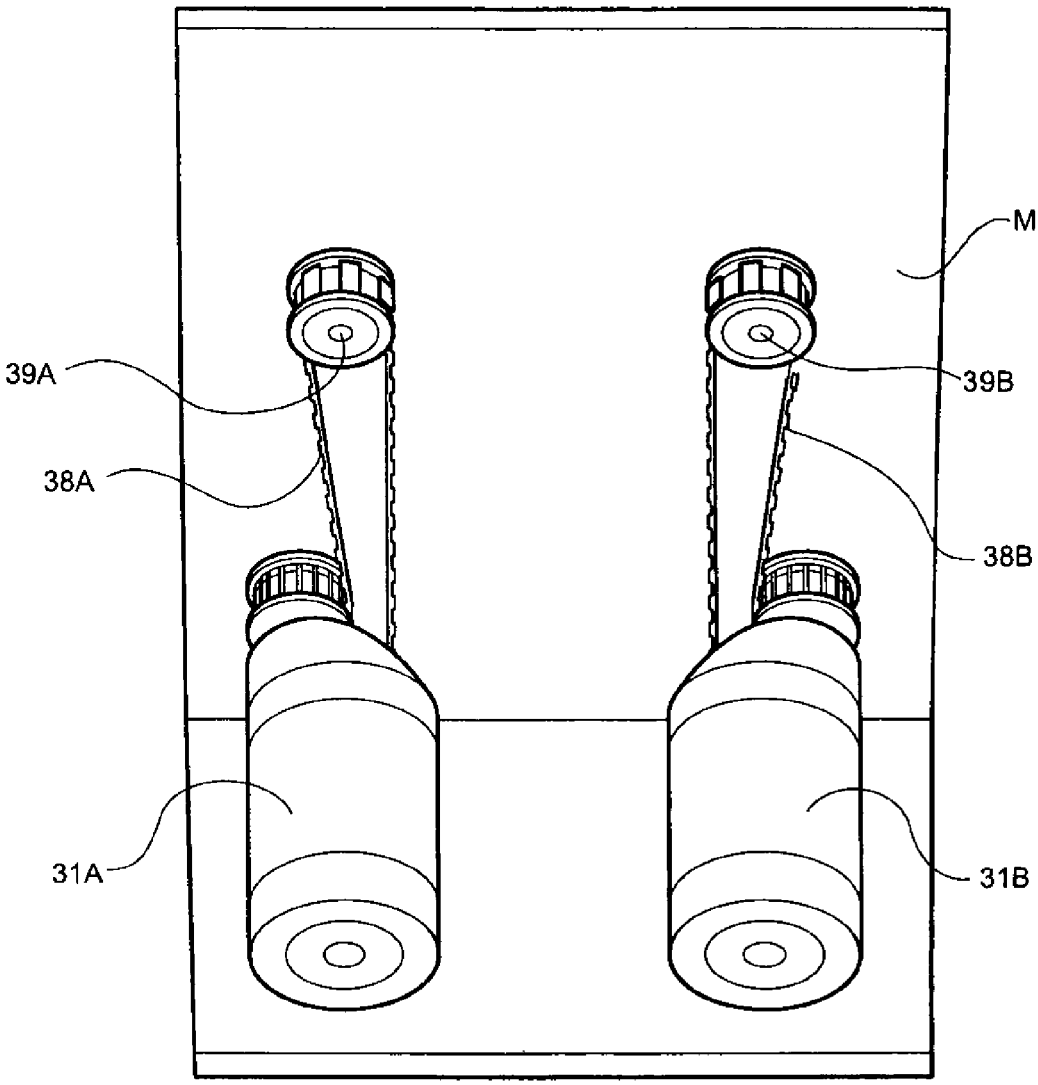
FIG. 6 is a perspective view of the rear side of the mounting plate of the first and second yarn roll assemblies according to one embodiment of the invention showing individual drive motors for each of the yarn roll assemblies.
Figure 7:
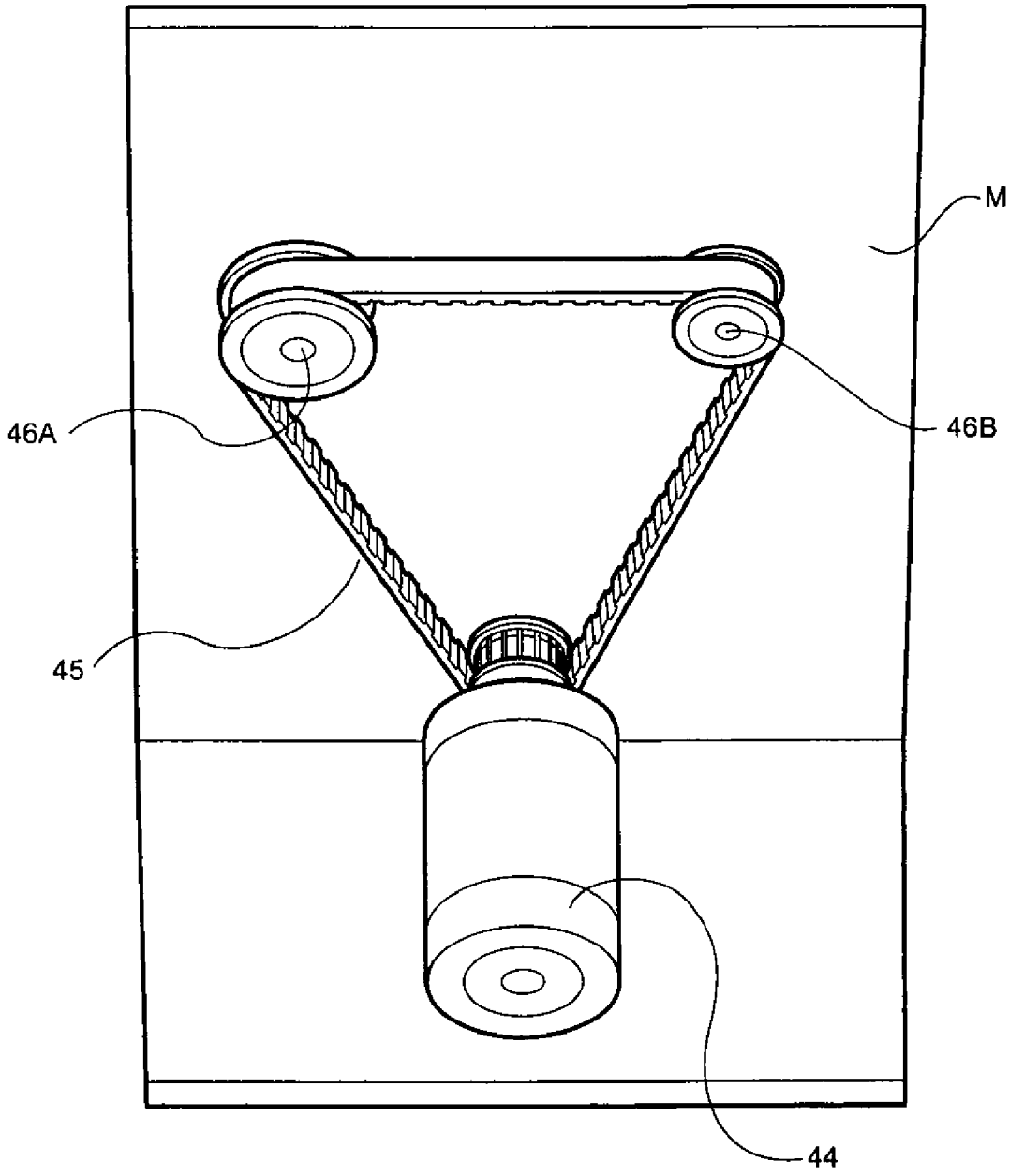
FIG. 7 is a perspective view of the rear side of the mounting plate of the first and second yarn roll assemblies according to another embodiment of the invention showing a single drive motor driving both of the yarn roll assemblies.

Referring now to FIGS. 5-7, the yarn conditioner 30 is described in further detail. As noted above, the yarn conditioner 30 is comprised of two yarn roll assemblies 33A and 33B mounted to a mounting plate "M". Yarn roll assembly 33A is comprised of an entry roll 34A, a tension roll 35A, a tracking roll 36A and a feed roll 37A. Feed roll 37A is driven by a motor 31A through a timing belt 38A and a feed roll drive pulley 39A mounted on the feed roll 37A. A nip belt 40A extends around the entry roll 34A, tension roll 35A, tracking roll 36A and feed roll 37A. The tension roll 35A is adjustable to vary the length of the path of and thus the tension on the nip belt 40A. The tracking roll 36A is adjustable to position the nip belt 40A in the proper position on the feed roll 37A. The entry roll 34A, tension roll 35A and tracking roll 36A have crowned surfaces to further insure correct tracking of the nip belt 40A.

Yarn roll assembly 338 is comprised of an entry roll 34B, a tension roll 35B, a tracking roll 36B and a feed roll 37B. Feed roll 37B is driven by a motor 31B through a timing belt 38B and a feed roll drive pulley 39B mounted on the feed roll 37B. A nip belt 40B extends around the entry roll 34B, tension roll 35B, tracking roll 36B and feed roll 37B. The tension roll 35B is adjustable to vary the length of the path of and thus the tension on the nip belt 40B. The tracking roll 36B is adjustable to position the nip belt 40B in the proper position on the feed roll 37B. The entry roll 34B, tension roll 35B and tracking roll 36B have crowned surfaces to further insure correct tracking of the nip belt 40B.

The yarn 10 passes from the creel 20 and into the nip between the nip belt 40A and the feed roll 37A. The yarn 10 is positively fed around the lower peripheral surface of the feed roll 37A between the feed roll 37A and the nip belt 40A. The tension and friction between the feed roll 37A and the nip belt 40A results in a positive feed across the top of the tension roll 35A and across a gap to the entry roll 34B of the yarn roll assembly 33B.

Motor 31B drives feed roll 37B at a rate that is sufficiently greater than the speed of feed roll 37A to cause the yarn 10 to be stretched. The high friction between the respective feed rolls 37A, 37B and the nip belts 40A and 40B prevents yarn slippage and results in a uniform elongation sufficient to remove or loosen most of the interlace nodes 11. The yarn 10 exits the yarn roll assembly 33B under relatively high tension with all of the crimp temporarily removed. The yarn 10 is passed through a yarn guide 42 and is delivered to the tension reducer 51 as described above, where the yarn 10 recovers its latent crimp.

The range of stretch of the yarn 10 imparted by the yarn roll assemblies 33A and 33B is in the range of one percent to 25 percent, with a stretch in the range of 7-20 percent be more typical.

By comparing FIGS. 6 and 7 it can be seen that either two motors 31A, 31B or a single motor 44 can be used to drive the yarn conditioner 30. In FIG. 6, the feed rolls 37A, 37B are driven by separate 1 horsepower electric motors 31A, 31B, with the rpm of the feed rolls 37A, 37B being determined by the diameter of the feed roll drive pulleys 39A, 39B. As noted above, an encoder 32 can be used to control the motors 31A, 31B.

As shown in FIG. 7, motor 44 can be used to drive both of the feed rolls 37A, 37B by means of a timing belt 45 and respective feed roll drive pulleys 46A, 46B. As above, the diameter of the feed roll drive pulleys 46A, 46B determines the rpm of the feed rolls 37A, 37B, with the larger diameter feed roll drive pulley 46A rotating at a lesser rpm than the feed roll drive pulley 46B.

A yarn conditioner is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A yarn conditioning apparatus, comprising:

(a) a yarn supply for supplying a multifilament, crimped-yarn having interlace nodes;

(b) a first yarn roll assembly for accepting the yarn from the yarn supply at a predetermined yarn feed rate, the first yarn roll assembly comprising an entry roll, a tension roll positioned in spaced-apart relation to the entry roll downstream therefrom, a feed roll positioned between the entry roll and the tension roll, and a nip belt extending around a belt path defined by the entry roll, the tension roll and the feed roll;

(c) a second yarn roll assembly for accepting the yarn from the first yarn roll assembly and having a yarn feed rate greater than that of the first yarn roll assembly;

(d) a first tension reducer for accepting the yarn from the second yarn roll assembly;

(e) an entangler for accepting the yarn from the first tension reducer and entangling the yarn;

(f) a second tension reducer for accepting the yarn from the entangler; and (g) a winder for accepting the yarn from the second tension reducer.

2. A yarn conditioning apparatus according to claim 1, wherein the first yarn roll assembly comprises the feed roll and the entry roll for passing a yarn therebetween under a positive, non-slipping condition.

3. A yarn conditioning apparatus according to claim 1, wherein the second yarn roll assembly comprises a feed roll and an entry roll for passing a yarn therebetween under a positive, non-slipping condition.

4. A yarn conditioning apparatus according to claim 1, wherein the second yarn roll assembly comprises:

(a) an entry roll;

(b) a tension roll positioned in spaced-apart relation to the entry roll downstream therefrom;

(c) a feed roll positioned between the entry roll and the tension roll; and (d) a nip belt extending around a belt path defined by the entry roll, the tension roll and the feed roll.

5. A yarn conditioning apparatus according to claim 4, wherein the first and second yarn roll assemblies each include a tracking roll positioned intermediate the respective entry rolls and tension rolls.

6. A yarn conditioning apparatus according to claim 4, further comprising a drive motor for driving both the first and second feed rolls at their respective feed rates.

7. A yarn conditioning apparatus according to claim 4, further comprising a first drive motor for driving the feed roll of the first yarn roll assembly and a second drive motor for driving the feed roll of the second yarn roll assembly.

8. A yarn conditioning apparatus according to claim 1, wherein the feed rate of the second yarn roll assembly is between 7 and 20 percent greater than the feed rate of the first yarn roll assembly.

9. A yarn conditioning apparatus, comprising:

(a) a creel for supplying a multifilarnent, crimped-yarn having interlace nodes;

(b) a yarn-stretching conditioner for accepting the yarn from the creel and stretching the yarn to remove the interlace nodes, the yarn-stretching conditioner comprising first and second yarn roll assemblies each including an entry roll, a tension roll, a tracking roll, a feed roll and a nip belt;

(c) a first tension reducer for accepting the yarn from the yarn-stretching conditioner and reducing tension in the yarn;

(d) an entangler for accepting the yarn from the tension reducer and entangling the yarn;

(e) a second tension reducer for accepting the yarn from the entangler and reducing tension in the yarn; and (f) a winder for winding the yarn.

10. A method of conditioning a yarn having spaced-apart interlace nodes, comprising the steps of:

(a) stretching the yarn between a first yarn roll assembly and a second yarn roll assembly to reduce the interlace nodes, the first and second yarn roll assemblies each comprising an entry roll, a tracking roll, a feed roll and a nip belt;

(b) relieving tension in the yarn;

(c) entangling the yarn;

(d) further relieving tension in the yarn; and (e) winding the yarn.

11. A method according to claim 10, wherein the step of stretching the yarn comprises the step of successively feeding the yarn between the feed roll and the nip belt of the first yarn roll assembly and the feed roll and the nip belt of the second yarn roll assembly.

12. A method according to claim 10, wherein the step of stretching the yarn comprises the step of stretching the yarn between 1 and 25 percent.

13. A method according to claim 10, where the first and second yarn roll assemblies each further comprise a tension roll.

14. A method according to claim 10, wherein the step of entangling the yarn comprises at least one of air-entangling, rotary jet processing, rotary twist processing and fluid twisting.

15. A method according to claim 10, wherein the first and second yarn roll assemblies are mounted to a mounting plate.

* * * * *